US005450116A

United States Patent [19]

Weiselfish et al.

[11] Patent Number: 5,450,116

[45] Date of Patent: Sep. 12, 1995

[54] APPARATUS FOR GENERATING A SPREADING INFORMATION TAPE

[75] Inventors: Jacob Weiselfish, Hartford; Michael T. Silva, Enfield, both of Conn.

[73] Assignee: P-M Acquisition Corp., Paterson, N.J.

[21] Appl. No.: 121,982

[22] Filed: Sep. 14, 1993

[51] Int. Cl.[6] ..... B41J 2/325

[52] U.S. Cl. ..... 347/171; 364/468; 364/469; 364/470; 364/471; 364/235.4; 364/930.4; 364/930.41; 364/930.42; 364/DIG. 1

[58] Field of Search ..... 346/76 PH; 400/120; 364/468, 469, 470, 235.4, 930.4, 930.41, 930.42; 347/171

[56] References Cited

U.S. PATENT DOCUMENTS 5,172,326 12/1992 Campbell, Jr. et al. ..... 364/470

5,353,355 10/1994 Takagi et al. ..... 364/470

*Primary Examiner*—Huan H. Tran

*Attorney, Agent, or Firm*—Morgan & Finnegan

[57] ABSTRACT

An apparatus automatically generates a tape having splice area and other markings which indicate acceptable splice points on a length of fabric from which garment pattern pieces are to be cut. The apparatus includes a computer for calculating splice and other pertinent points on a fabric layup. The apparatus also includes a controller for receiving printing commands from the computer. The apparatus also includes a printer responsive to signals from the controller for quickly and accurately printing on the tape splice information and data identifying the marker for which the splice point indicating tape was generated. The apparatus also includes a tape advance system for advancing the tape from a supply roll to the printer and then to a takeup roll.

9 Claims, 5 Drawing Sheets

APPARATUS FOR GENERATING A SPREADING INFORMATION TAPE

FIELD OF THE INVENTION

The present invention relates to the field of fabric Spreading, and in particular to an apparatus for generating a marking strip containing splice points and other pertinent fabric spreading information.

BACKGROUND OF THE INVENTION

Traditionally, the task of marking splice points on a length of fabric in a fabric layup has been accomplished manually by a garment worker. It has long been known that such a method significantly slows production time and often results in the waste of valuable materials. Such production delays and waste significantly add to the total cost of garment production.

Splice points are points along a length of fabric at which it is desirable to join the ends of two sections of fabric. The term "splicing," as used in the art of fabric cutting, generally means that the ends either abut one another or overlap, without physical attachment. Splicing may be required in two different situations. First, splicing can be used to join the end of an exhausted roll of fabric to the beginning of a fresh roll. Second, splicing can be used to rejoin a length of fabric from which a defective piece has been removed. In either instance of splicing, however, the technique is used to create a continuous stream of fabric from which pattern pieces can be cut. Pattern pieces are cut from the fabric in accordance with a predetermined fabric "marker." A marker is a template having pattern pieces arranged thereon so as to optimize the use of the fabric.

As stated, an operator has typically been employed to generate splice markings manually. That is, a garment worker has had to inspect the layout of a marker and visually determine where in the marker acceptable splice points may exist. From the manual calculation, the operator would mark the underlayment paper or the table itself along one side of the fabric layup. Workers, called "spreaders," use the marked tape to determine where suitable splice points in the fabric exist.

In an attempt to automate the procedure, one system provides means for displaying a depiction of a marker's layout, such as on a computer monitor. From such depiction, an operator, using only judgment gained from experience, can manually insert estimated splice points into the depiction by means of a mouse or other pointing device. The system then outputs a punch tape having marks thereon corresponding to the desired splice points. The punch tape is then aligned along one edge of the fabric to be cut in the manner described above.

Accurate determination of optimal splice points is a particularly complex process. When determining where to place the splice point, the operator must assess the degree to which pattern pieces may overlap the splice line, where and how many small pieces (such as belt-loops, pockets, pant flys, sections of waistbands, etc.) must be cut from the marker and whether they can be cut elsewhere in the marker, and the effect on splice point selection of patterns or motif on the fabric to be cut. In view of these considerations, it will be appreciated that manual determination of the precise location and number of desirable splice points is extremely difficult and equally susceptible to error and delay.

Inaccurate calculation and marking of splice points can result in both delays and material waste. If, for instance, a splice point is inaccurately calculated to be or marked farther from an end than necessary, the excess fabric is wasted, resulting in an increased cost per garment. Similarly, when a worker inaccurately calculates and marks too few splice points within a marker, excess fabric may be removed and discarded for a given defect. This, again, results in the waste of material and higher labor costs, since rolls of fabric must be added more frequently than necessary.

The present invention is directed to an apparatus for accurately and optimally marking splice points, as well as other useful information, for a length of fabric in a layup, and therefore eliminating the drawbacks encountered with previous manual marking techniques. The invention achieves these results using automated technology which substantially reduces the incidence of marking errors while also substantially increasing the speed at which such marking is accomplished.

SUMMARY OF THE INVENTION

In accordance with the present invention, an apparatus generates a strip containing spreading information for a length of fabric from which one or more pieces will be cut. The apparatus includes a computer including means for calculating the spreading information, and means responsive to the calculating means for generating printer commands. The apparatus also includes a controller, the controller including a processor responsive to the printer commands, the processor including means for generating printer control signals. The apparatus also includes a printer responsive to the printer control signals for printing the information on the strip and tape advance means for advancing the tape through the printer such that the information can be printed on the strip at desired locations.

DETAILED DESCRIPTION

The invention will now be described in detail with reference to the accompanying drawings.

Figure 1:
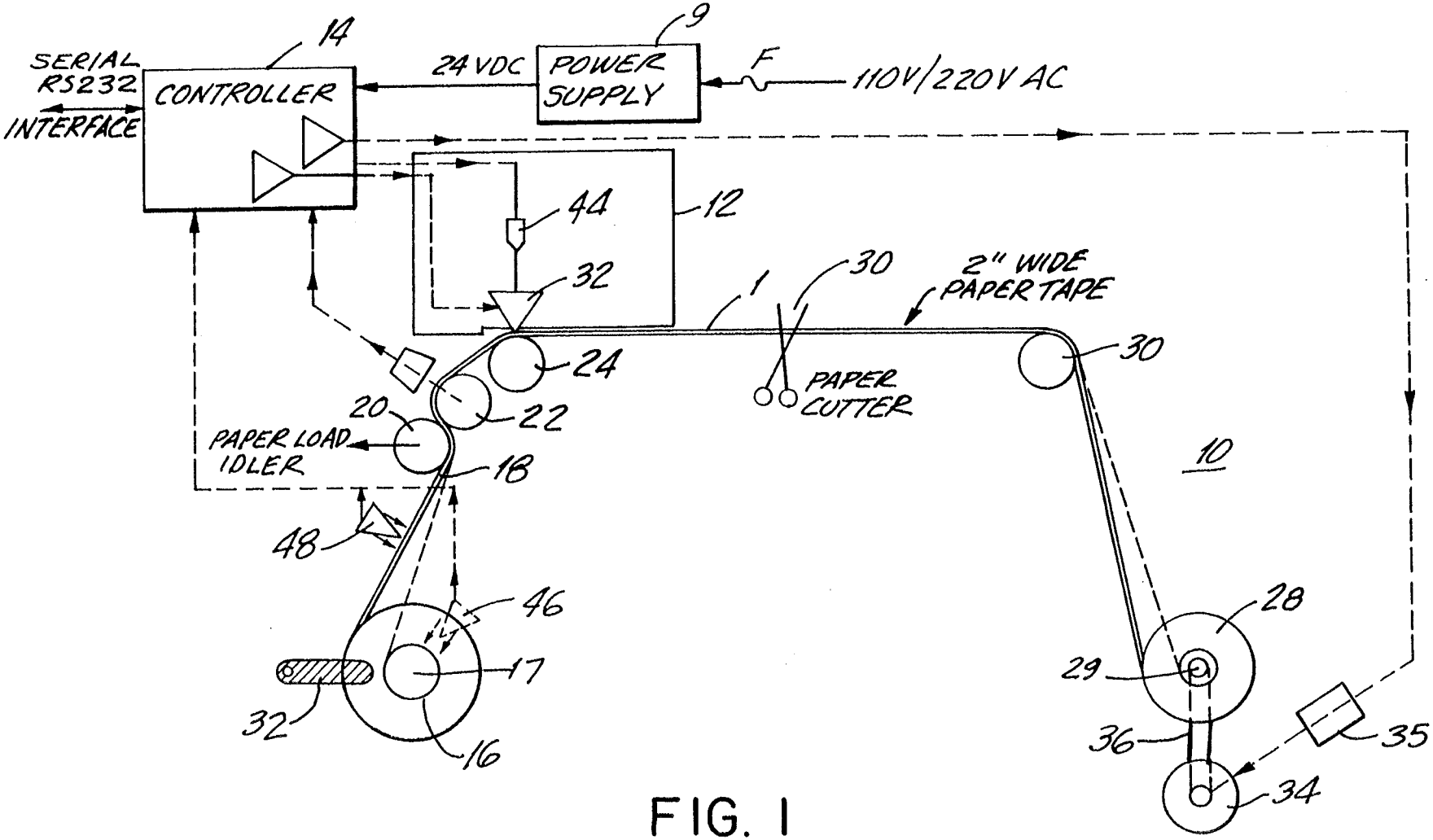
FIG. 1 shows one embodiment of an apparatus according to the present invention.

Referring to FIG. 1, an apparatus for generating a fabric marking strip will now be described. The apparatus includes four main components: a tape 1; a tape advance system 10; a printer 12 with associated controller 14; and a computing device 100. These components will now be discussed in turn.

The tape 1 is the final product of the system of the present invention. In its final form, the tape includes splice markings defining desired splice areas, start and end points of a marker, as well as information pertaining to the characteristics of the cut. These markings will be discussed in more detail below with reference to FIG. 3.

In a preferred embodiment of the invention, the tape is made from a paper suitable for thermal printing. However, any other suitable material can be used, depending upon the characteristics of the printer used in the system. The material preferably will be relatively inexpensive, durable for a given thickness to withstand handling by workers, and capable of being stored on rolls. The use of a printed paper tape instead of punch tape yields the advantages of rapid production time and increased information-carrying capability. In addition, the tape can have an adhesive backing so that it can be affixed to the surface of a cutting table. The adhesive surface preferably is one that will allow easy removal from the table as well.

The tape advance system 14 provides means for automatically advancing the tape from a supply roller, into printing position, and onto a takeup roll with a minimum of operator action.

The paper tape 1 is stored, in a preferred embodiment, on a roll such as feed roll 16. From feed roll 16, the paper tape 1 is threaded through a series of idlers 20, 22, 24 and 30 to a takeup roll 28. A cutting device 38 can be located between idlers 24 and 30.

The feed roll 16 is supported by a feed axle 17, which allows the feed roll to rotate freely to dispense the tape when desired. Tension is maintained in the tape by means of a friction arm 32. The tension maintained by friction arm 32 prevents wrinkling of the tape when it is taken up by takeup roll 28, and also prevents the tape from jamming in the downstream idlers. Friction arm 32 can be adjusted to attain a desired tension in the paper tape.

Two sensors are associated with the feed roll to provide feed roll status information to the controller 14. Paper low sensor 46, preferably an optical sensor, generates signals in response to the current supply of paper on the feed roll reaching a predetermined low level. Such signals are used by the controller to initiate a warning to the operator, such as with indicating light 205 (FIG. 2), that the roll should be replaced prior to generating additional splice point markings. Out-of-paper sensor 48, also preferably an optical sensor, provides signals to the controller indicating that the feed roll has run out of paper. The controller will stop the operation and generate an appropriate response, such as by lighting indicating light 206 (FIG. 2), to inform the operator of the out-of-paper condition.

Each of the idlers performs a distinct function. Paper load idler 20, preferably formed of a resilient material, maintains the tape on the encoder idler 22 to prevent slippage between the tape and the encoder idler. Paper load idler 20 can be manually disengaged to facilitate easy threading of the tape through the series of idlers when the feed roll is replaced.

Encoder idler 22 is mechanically coupled to an encoding device 21, such as an optical encoder. The encoder generates pulsed positional signals. The number of pulses is proportional to the length of paper tape fed by the feed roll. When combined with time information, the output of the optical encoder can be used to obtain a signal useful for synchronizing the rate of tape advance and printing operations. It is to be understood that the encoder can be replaced by an analog device performing the same function, or any other suitable device capable of generating positional indication signals. The pulses generated by the coding device 21 are directed to controller 14 for processing in a manner to be described later.

From the encoder idler 22, the paper tape 1 passes around the print head idler 24. The print head idler 24, in a preferred embodiment, is formed of a resilient, heat resistant material in accordance with the specifications of the preferred printer. Print head idler 24 can be formed, however, of any material suitable for the needs of the particular printer chosen. During printing, the tape is sandwiched between the print head idler 24 and the print head 32 of the printer. The print head idler, therefore, provides a resilient, temperature resistant support which optimizes printing results, minimizes print head damage when the print head is placed in contact with the paper tape, and can withstand the high temperatures associated with thermal printing procedures.

After passing the print head idler 24, the paper tape passes along takeup idler 30 and on to the takeup roll 28. The takeup idler 30 functions to maintain the paper tape in alignment with the print head 32.

The paper tape is advanced to the takeup roll by means of takeup motor 34. Takeup motor 34 is coupled to the axle 29 of takeup roll 28 by means of a drive belt 36. The takeup motor 34, in a preferred embodiment, can be a variable speed motor or stepper motor and is responsive to control signals generated by the controller 14 to provide the motive force for rotating the takeup roll 28 to advance the paper tape at a desired speed.

In a preferred embodiment of the invention, the system also includes a paper cutter 38 situated between the print head idler 24 and takeup idler 30. The cutter is used to cut the paper tape 1 when the end of a marker has reached the takeup roll. A particular takeup roll may include the splice information for a plurality of markers and then be removed from the tape advance system and sent to the cutting room to be used in the fabric spreading process as a splicing guide.

Calculation of splice point and other pertinent spreading information is performed by means of a personal computer, adapted to determine such information based upon input data describing the marker as well as data describing the operator's desires regarding the characteristics of the spread. The PC receives data describing the marker and the pattern pieces thereon from a computer aided design (CAD) system or the like, which is used to determine optimum pattern piece layout for a marker. Alternatively, input data can come from an information storage medium, such as a magnetic or optical disc on which data generated by a CAD or system has been stored. The data from such sources comprises perimeter coordinates of pattern pieces making up a marker.

As stated, the information governing the location of splice point markings reflects the characteristics of the pattern pieces and, in part, the desires of the operator. For instance, the operator can indicate the minimum and the maximum width of a splice area. The choice of minimum and maximum width may depend, in part, upon the geometry of the pattern pieces, their arrangement in a marker, and allowable fabric waste.

The operator can also indicate whether small pieces are allowed in the splice area. If such pieces are allowed in the splice area, then duplicative cutting may result.

The operator can also select an adjacent piece limit. The adjacent piece limit indicates whether a pattern piece in the vicinity of the splice is allowed to extend out of the splice area. If the limit is set for two inches, then two inches of a pattern piece in the vicinity of the splice point can extend out of the splice area.

The operator can also select a splice point buffer. The splice point buffer increases the width of the splice area to allow for minor cutting errors when the cutter cuts along a line indicated by a splice marking.

The operator can also indicate whether such pieces as belt loops and waist band segments can be ignored for purposes of determining a splice location. Often a marker will include many more of such pieces than necessary for producing a particular garment. Therefore, it may be desirable to ignore these pieces if the effect of ignoring them results in more splice points.

In addition, information including the starting location of the spread, the cut file number, the marker identification number, the cut file length, the cut file width and the section number (used when it is desired to repeat a marker) can be extracted by the PC from the data supplied by the CAD. This information, including the cut number, along with user-supplied information, can be printed on the tape along with the splice point markings to allow ease of identification.

Figure 4A:
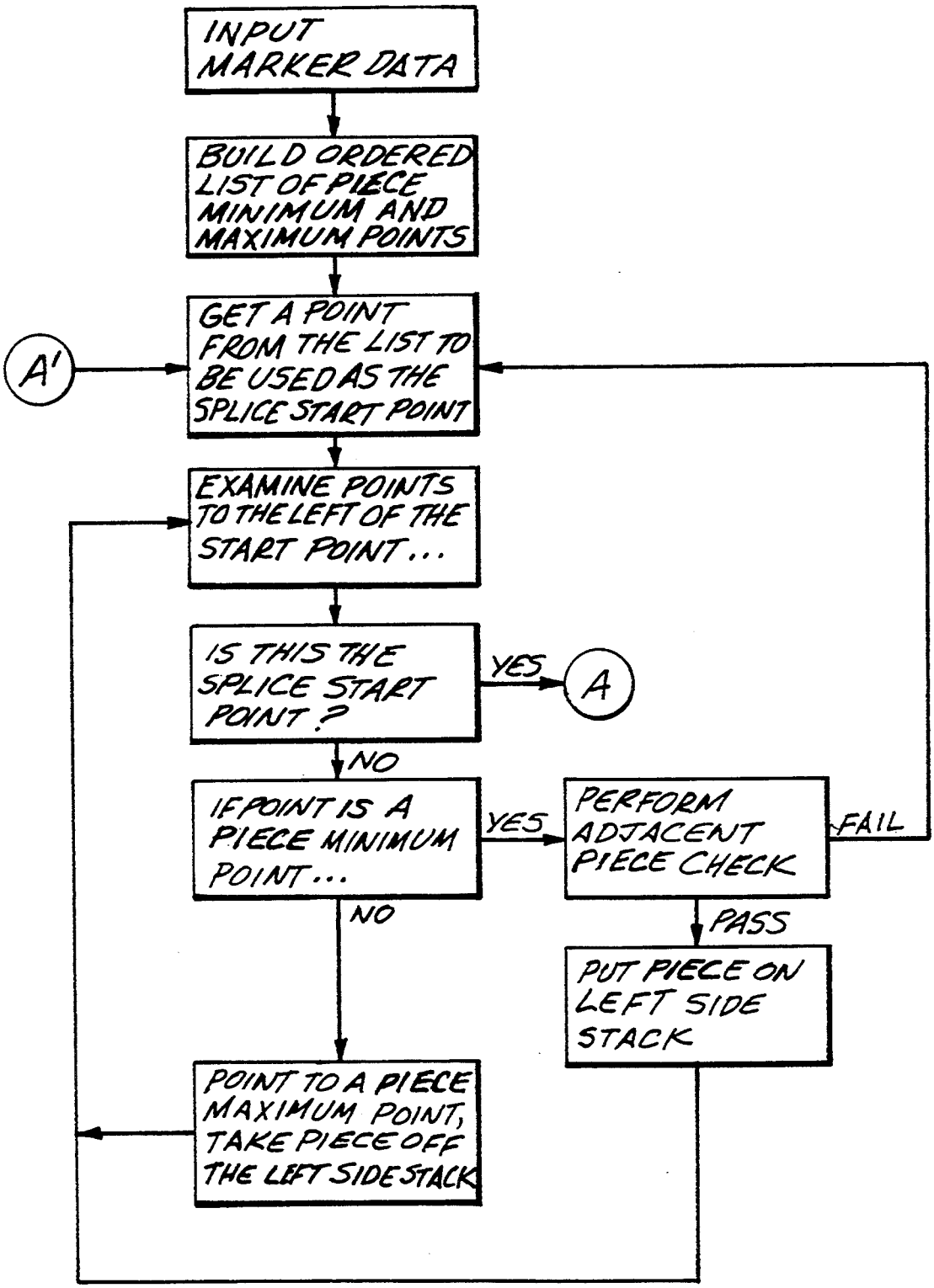
FIGS. 4A and 4B is a flow diagram representing the steps carried out by a computer to determine optimum splice points in a marker.
Figure 4B:
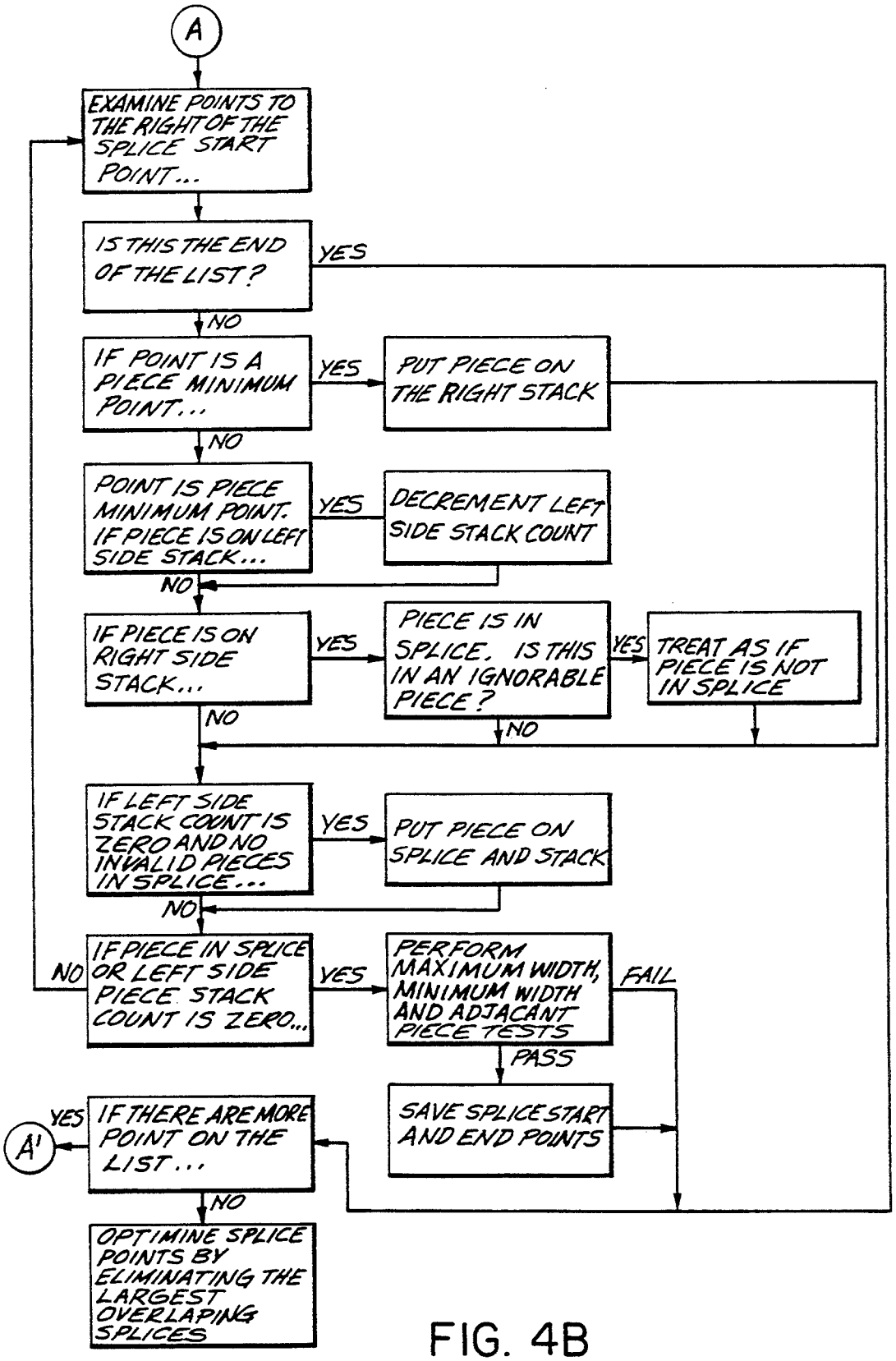

The data received from the CAD system or storage medium, along with user-inputs, will be used by the PC to calculate splice points as follows. FIGS. 4A and 4B together show a flow diagram of operations performed by the PC to determine optimum splice points in a markup.

The procedure for determining optimum splice points begins by reading in the marker data. This data is in the form of pattern piece perimeter coordinates, which can be visualized as falling on an x-y plane, the length of the fabric being the x direction and the width being the y direction. From this data, an ordered list is constructed, the list including all minimum and maximum points of the pattern pieces in the marker. A minimum point is defined as the left most point (i.e., minimum x value) of a particular pattern piece, and the maximum is the right most point. From this list a point is selected to be the splice start point. In the first iteration, the point selected will be a minimum, and in subsequent iterations the point can be the maximum of the same piece or the minimum of a subsequent pattern piece.

Next, points to the left of the point selected as the splice start point are examined. The first point examined is the minimum or maximum point falling farthest to the left of the splice start point which has not already been examined during a prior iteration. If the point is the start point itself, the iteration terminates, and the process proceeds to the next stage (i.e., "A" in FIG. 4A). If not, and if the examined point is a minimum point, then an adjacent piece check is performed. Under the adjacent piece check, if the distance between this minimum point and the splice start point is less than the operator-selected adjacent piece limit, then the minimum does not constitute a valid splice point, and the program returns to A'. If the distance is greater than or equal to the adjacent piece limit, it indicates that the piece corresponding to the minimum starts to the left of the splice start point, and the piece is stored in a register known as the "left side stack", and the point immediately to the right of the previously examined point is then examined in the same manner.

If instead the point initially examined was a maximum, then the piece to which that maximum corresponds is taken off the left side stack, and the next point is examined.

After all points to the left of the splice start point have been examined, points to the right are examined. Referring now to FIG. 4B, it will be seen that the point occurring immediately to the right of the splice start point is examined first. If the end of the list has not been reached and if the point is a piece minimum, the corresponding piece is stored in a register known as the "right side stack". If the point is a maximum, and if the corresponding piece has already been stored in the left side stack, it means that the corresponding piece began prior (to the left of) the splice start point and a left side stack counter is decremented by one. If the maximum corresponds to a piece already stored on the right side stack, the piece is in the splice. If the piece is in the splice, then it is tested to determine whether it is an ignorable piece, i.e., if it is a small piece, as discussed previously. If so, the piece is treated as if it is not in the splice.

If the piece was not on the right stack, was determined not to be in the splice or was determined to be in the splice but treated as if it did not fall within the splice, the left stack is examined. If the left stack is zero, and if there are no invalid pieces in the splice, then that piece is stored in a splice end stack. Then, or if one of the two preceding conditions was not satisfied, the following test is performed. If the piece is in the splice or if the left side stack count is zero, then maximum width, minimum width and adjacent piece tests are performed in accordance with operator supplied set points, as discussed previously. If all of these tests pass, then the splice start and end points are saved as valid.

If any of the tests fails, or after the valid splice points have been saved, and if there are no more points left in the ordered list, then splice points are optimized if there are overlapping splices. Optimization is performed by eliminating the largest splices from among groups of overlapping splices. Finally, if there are more splice points to be examined, then the program returns to A' as shown in FIGS. 4A and 4B.

After the optimum splice points have been determined in the manner described above, the computer generates appropriate printer commands. These printer commands are processed by the control circuitry of the printer in a manner to be described.

When proper printing instructions have been determined in accordance with the foregoing description, the operator instructs the PC to begin the printing sequence. When the operator has made such a request, printer commands (such as definitions of graphic images, locations, printing fonts, scaling, etc.) are generated by the PC and sent to controller. Once printing has commenced, an operator can control, such as with a keyboard 200, the starting and stopping of the system by means of push buttons 201 and 202. The keyboard also includes indicating lights 203, 204, 205 and 206 which indicate power on, ready, paper low and paper out, respectively. Control signals for the indicating lights are provided by the microprocessor 40, via amplifier 43'''.

The printing apparatus 12 of the present invention will now be described. The preferred printer is a thermal printer having means for adjusting the intensity for the printer output by means of preheating the print head and controlling the energy of each of its printing elements. The printing apparatus includes a print head 32, which is coupled to a solenoid operator 44 for raising and lowering the head alternately into and out of contact with the tape. The preferred print head is a thermal print head, model no. SMP/SMO-050-150, manufactured by Gulton Industries. Both the print head 32 and the solenoid operator 44 are controlled by signals from the controller 14. Such signals, amplified by amplifiers 43' and 43'', respectively, contain print information, i.e., information describing what is to be printed on the tape as it passes (FIG. 3) and position information, i.e., information directing the solenoid operator 44 when to lower or raise the print head from its printing position.

The print head 32, normally in its raised position, is lowered for printing only when printing is required. Minimizing the time during which the print head contacts the paper tape 1 prolongs the life of the print head by minimizing abrasive wear. A thermal printer is preferred because it can print relatively quickly, although any suitable printer can be used without departing from the scope of the invention. After the microprocessor 40 has received printer commands from the PC 100 via serial bus 41, which uses RS-232 protocol, it stores the information in an on board random access memory 5. The microprocessor will generate, in accordance with resident software, appropriate signals for directing the printing of splice information on the tape 1.

Figure 2:
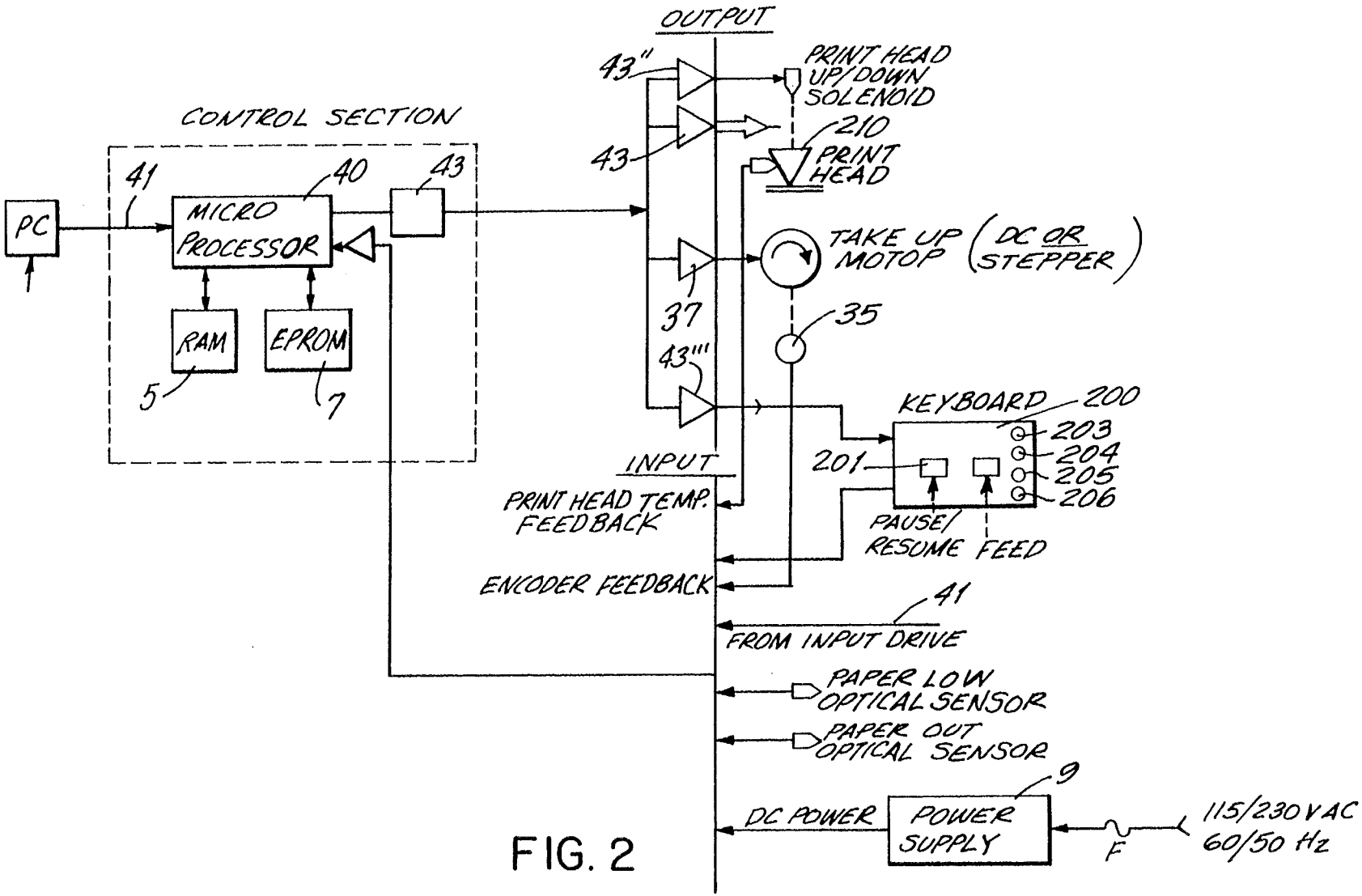
FIG. 2 is a schematic representation of the control circuitry of the apparatus of FIG. 1.

Referring to FIG. 2, the controller 14 of the printer will now be described. The controller 14 includes a microprocessor 40, which receives information signals from sensors located in the paper advance system, as well as input signals from an operator-controlled system. The preferred microprocessor is an Intel 8031, although many other microprocessors are suitable. In a preferred embodiment, the controller is powered by a DC power supply 9. In response to the printer control signals, the microprocessor 40 will generate printhead and solenoid control signals and apply them to a printer and solenoid driver circuit 43 compatible with the thermal printer. In a preferred embodiment, the printer and solenoid driver circuit is manufactured by Gulton Industries, model no. UMCB-lAS 9045, and can control the print head to adjust intensity as the speed of the feed system changes, so as to maintain a uniform printing intensity.

The printer and solenoid driver circuit 43 receives the control signals and directs both the solenoid and print head operations described previously. Specifically, the printer control interface circuit 43 will direct the solenoid 44 to lower during print operations and to raise during idle periods. The printer interface will supply to the print head control signals indicative of the matter to be printed on the passing tape.

In addition to generating the signals applied to the printer and solenoid driver circuits, the microprocessor 40 controls the paper tape speed and position. The encoder 35, driven by the paper tape, feeds back pulses from which position and rate information can be derived. The microprocessor, using resident software, compares the desired speed and position of the paper tape with the actual speed and position derived from the encoder signals. This process is performed in real time to achieve maximum accuracy and performance.

In addition to the position feedback signals described above, the microprocessor also receives inputs describing the current status of the paper tape supply from paper low sensor 46 and paper out sensor 48. Each of these sensors is an optical sensor which optically detects the condition of low paper supply or no paper supply and generates a corresponding signal. When the microprocessor receives the paper low signal, the printer is directed to pause until the paper low condition is cleared or until manually directed to resume. Also, a warning signal is generated, informing the operator of the low paper supply condition. When the microprocessor receives the out-of-paper signal from sensor 48, it causes printing operations to cease until the condition is rectified. Temperature signals are also provided by a print head temperature sensor 210.

Figure 3:
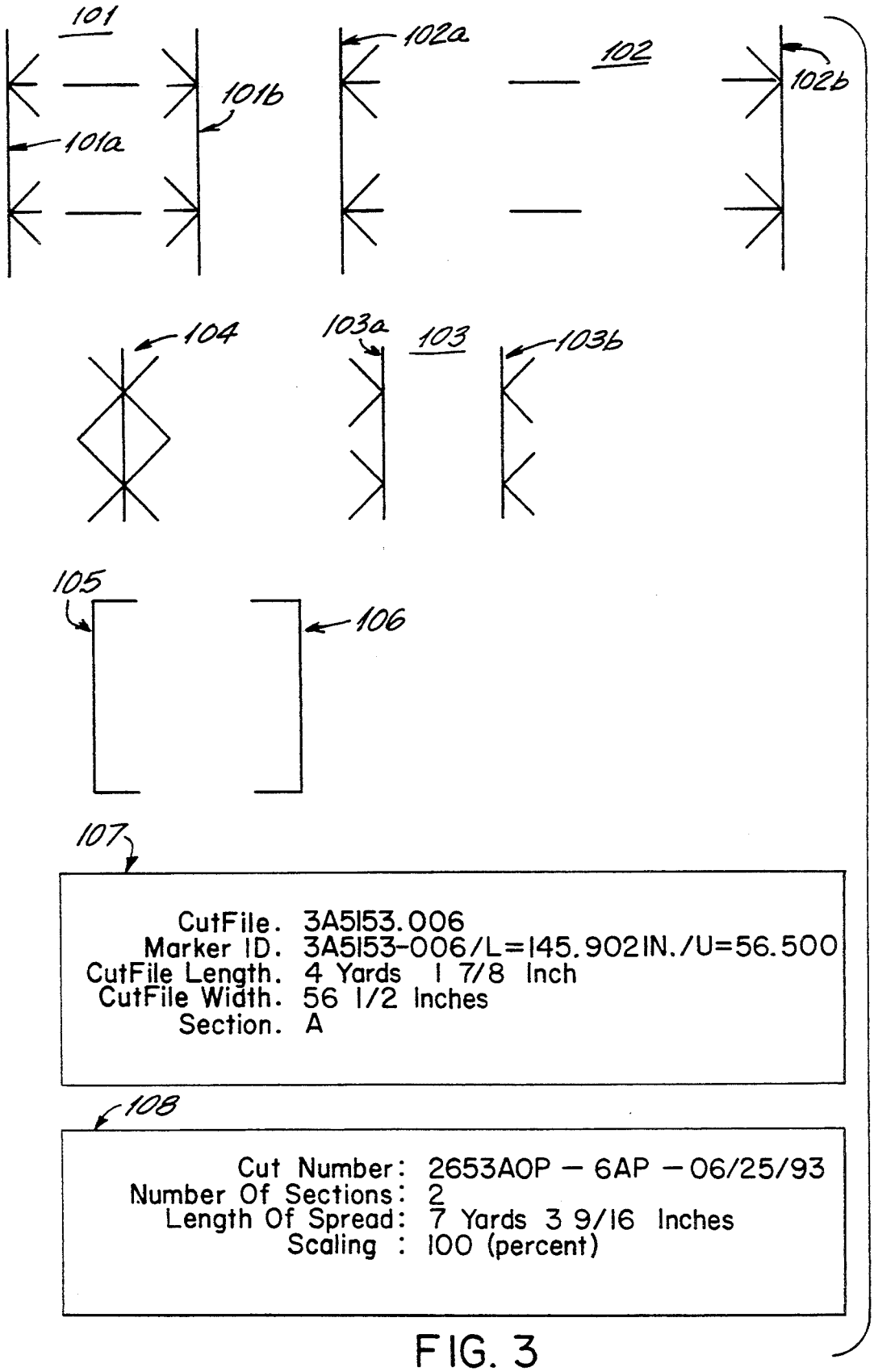
FIG. 3 shows an example of a marking strip generated by the apparatus of FIG. 1.

Referring to FIG. 3, the symbols on a tape generated by the apparatus of the present invention will now be described. The tape includes a number of printed symbols indicating various splice-related points on the fabric to be cut. It will be understood that the printed symbols are arbitrary and can be replaced with any suitable printed symbols capable of conveying accurate splice information to the operator.

The printed symbol labelled 101 denotes a typical splice area. The splice area is defined by lines **101*a* and 101*b***, which indicate the beginning and ending of the splice area, respectively. The area between the lines is the splice area, and may include allowances for fabric buffers and for minimum splice width, as selected by the operator.

Printed symbol 101 will be used to guide the operator in eliminating a flaw from a marker in the following manner. If the spreader is spreading from left to right and discovers a flaw in the fabric occurring to the right of line **101*b*, the spreader will cut the fabric along a line to the right of the flaw and again along a line indicated by line 101*b*. The spreader will then resume spreading by placing the loose end of fabric on line 101*a***. This will create an overlap of fabric in the splice area. It will be understood that spreading can be conducted bidirectionally using the same tape, i.e., the splice markings are accurate when spreading from either direction.

Printed symbol 102 is the equivalent of symbol 101, but with a larger splice width. Printed symbol 103 is the equivalent of symbol 101, but with a narrow splice width.

Printed symbol 104 indicates a splice point where the start and end points are coincident. Such splice points can occur, for instance, when a series of squares are to be cut from the fabric, the squares being separated by an imaginary line in the y-direction. (The length of the fabric being the x-direction). To eliminate a flaw when spreading from left to right, the operator removes the flawed piece by cutting the fabric along line 104 and along a line parallel to line 104 and to the right of the flaw. The operator then pulls the remaining end on the right to abut the end on the left and the splice is accomplished.

Printed symbols 105 and 106 indicate the beginning and end points of a marker, respectively, and themselves can be used as splice points in the manner described above.

As previously explained, information input into the computer of the apparatus of the present invention can be printed in textual form on tape 1 along with the various splice indicating symbols. Examples of such information appear in boxes 107 and 108 of FIG. 3. The information appearing in box 107 is known as the section header, and appears at the beginning and end of a marker, inside the markings 105 and 106, respectively. The information appearing in box 108 is known as the "spread" or "cut" header and will appear at the beginning and end of a tape for a spread.

Although several embodiments of the invention have been illustrated in the accompanying drawings and described in the foregoing detailed description, it will be understood that the invention is not limited to the embodiments disclosed, but is capable of numerous rearrangements, modifications and substitutions without departing from the scope of the invention.

What is claimed is:

1. An apparatus for generating a strip containing spreading information for a length of fabric from which one or more pieces will be cut, comprising:

a computer including means for calculating said spreading information, and means for generating printer commands;

a controller, said controller including a processor responsive to said printer commands for generating printer control signals and tape advance control signals;

a printer responsive to the printer control signals for printing said information on the strip; and tape advance means responsive to the tape advance control signals for advancing the strip through said printer such that said information can be printed on the strip at desired intervals.

2. The apparatus of claim 1, wherein said computer comprises means for reading data stored on a portable storage medium, and wherein said spreading information is calculated from said data.

3. The apparatus of claim 2, wherein said data includes perimeter coordinates of pattern pieces to be cut from said length of fabric.

4. The apparatus of claim 1, wherein said spreading information includes starting and ending points of a marker from which pattern pieces will be cut.

5. The apparatus of claim 1, wherein said tape advance means comprises:

a feed roll for supplying said strip to said printer;

a takeup roll for receiving said strip from said printer; and a motor coupled to said takeup roll.

6. The apparatus of claim 1, wherein the strip is suitable for thermal printing.

7. The apparatus of claim 1, wherein said printer comprises a thermal printing head.

8. The apparatus of claim 1, wherein the strip has an adhesive backing.

9. The apparatus of claim 7, wherein said printer includes a solenoid coupled to said print head for raising and lowering said print head.

* * * * *